US007082280B2

(12) United States Patent
Kim

(10) Patent No.: US 7,082,280 B2
(45) Date of Patent: Jul. 25, 2006

(54) TONER LAYER BLADE AND A DEVELOPING UNIT HAVING THE SAME FOR AN IMAGE FORMING APPARATUS AND A METHOD THEREOF

(75) Inventor: Soon-nam Kim, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 164 days.

(21) Appl. No.: 10/901,981

(22) Filed: Jul. 30, 2004

(65) Prior Publication Data

US 2005/0111888 A1 May 26, 2005

(30) Foreign Application Priority Data

Nov. 24, 2003 (KR) ..... 10-2003-0083496

(51) Int. Cl.
*G03G 15/09* (2006.01)

(52) U.S. Cl. ..... 399/274; 399/284

(58) Field of Classification Search ..... 399/107, 399/119, 222, 252, 265, 267, 274, 284
See application file for complete search history.

(56) References Cited

U.S. PATENT DOCUMENTS 5,819,145 A * 10/1998 Tanaka et al. ..... 399/274
5,937,253 A * 8/1999 Shimazaki et al. ..... 399/284
6,070,039 A * 5/2000 Yamaki et al. ..... 399/283
6,603,944 B1 * 8/2003 Tatsumi ..... 399/284

FOREIGN PATENT DOCUMENTS

| | | |
|---|---|---|
| JP | 09-329961 | 12/1997 |
| JP | 2000-347500 | 12/2000 |
| KR | 1999-0016849 | 3/1999 |

* cited by examiner

*Primary Examiner*—Hoan Tran
(74) *Attorney, Agent, or Firm*—Roylance, Abrams, Berdo & Goodman, LLP

(57) ABSTRACT

A regulating device and method regulating the thickness of a toner of an image forming apparatus. The device and method include a blade body for elastically contacting a developing roller supplying toner to a photosensitive medium, and a bending portion bent at a predetermined angle from the contacting portion of the blade body and the developing roller to regulate the layer thickness of the toner that is transferred to the developing roller, wherein the blade portion is formed such that its height is gradually reduced toward both ends of the bending portion so that the toner supplied to the developing roller goes over the ends of the bending portion, and a developing unit employing the same.

13 Claims, 7 Drawing Sheets

TONER LAYER BLADE AND A DEVELOPING UNIT HAVING THE SAME FOR AN IMAGE FORMING APPARATUS AND A METHOD THEREOF

CROSS-REFERENCE TO RELATED APPLICATIONS

This application claims the benefit under 35 U.S.C. § 119(a) of Korean Application No. 2003-83496, filed Nov. 24, 2003, in the Korean Intellectual Property Office, the entire contents of which is incorporated herein by reference.

BACKGROUND OF THE INVENTION

1. Field of the Invention

The present invention relates to an image forming apparatus using a one-component non-magnetic toner. More particularly, the present invention relates to a layer regulating device and method of a developing roller for uniformly regulating the toner layer on the developing roller.

2. Description of the Related Art

Conventional image forming apparatuses using one-component non-magnetic toner have a blade which is in contact with a developing roller to uniformly maintain the amount of toner layers on the developing roller. The technology for applying the blade has been previously filed by the present applicant in Korean Patent Publication 10-1999-016849 which is incorporated by reference in its entirety. FIG. 1 discloses the technology.

In FIG. 1, a photosensitive drum 1 is installed in a housing 2 having a prescribed shape. The surface of the photosensitive drum 1 is charged at a certain potential by a charging roller 3. The charged surface of the photosensitive drum 1 is partly exposed by an exposure unit 4, and accordingly, an electrostatic latent image is formed. The toner supplied through a developing roller 6 is transferred to the electrostatic latent image area, thereby developing the toner image. In order to supply the toner to the developing roller 6, the toner is accommodated in a predetermined space in the housing 2, and an agitator 9 in the toner receptacle 10 agitates the toner while moving. A toner supply roller 8 that rotates in contact with the developing roller 6 supplies the toner to developing roller 6 while being rotated in the same direction as the developing roller 6. In order to regulate the toner layer that attaches to the surface of the developing roller 6, a regulating blade 7 is installed in contact with the developing roller 6.

The regulating blade 7 comprises a metal plate having a predetermined thickness and an elastic force, and generates a contact pressure on the developing roller 6. The contact pressure via the elastic force allows the toner passing through between the blade 7 and the developing roller 6 to be charged with friction, thereby charging the toner at a certain polarity.

The toner layer formed by the developing roller 6 is determined by the height H from a contacting point between the developing roller 6 and the blade 7 to a free end of the blade 7 and the bending angle θ of the free end. In other words, the toner that is continuously supplied between the developing roller 6 and the blade 7 by the toner supply roller 8 impacts on a bending portion 7*a* and remains there for a predetermined time, thereby generating frictional charging. And, a part of the toner aggregated by the bending potion 7*a* overcomes the elastic force and passes through between the developing roller 6 and the blade 7, thereby forming a certain toner layer.

As shown in FIG. 2, to prevent the toner from spilling between both ends of the blade 7 and the inner wall of the housing 2, a sealing member 11 is connected to both ends of the blade 7. Accordingly, a large amount of toner substantially remains in a particular area formed by the bending portion 7*a* and both sealing members 11 for a long period of time, thereby generating frictional charging.

However, the image area where the toner is substantially developed in the photosensitive drum 1 begins from a portion inward by a certain distance from both ends of the photosensitive drum 1. Therefore, a large amount of toner is substantially consumed only in a section A of the developing roller 6, which corresponds to the image area of the photosensitive drum 1. The toner remains in both ends of the bending portion 7*a* except for section A for a long period of time.

The toner is continuously subjected to stress without being touched by the blade 7 due to the height H of the bending portion 7*a*. More specifically, the toner consists of resin material and an additive added to the surface of the resin material, and the additive may be drawn into the resin material, or a stress phenomenon in which the additive is separated from the resin material may occur. In addition, due to the frictional force, the toner melts and adheres to the contacting portion of the developing roller 6 and the blade 7. Therefore, the so-called fixed toner layer in the form of a belt that becomes gradually thick is formed. In this case, the blade 7 is raised by the fixed toner layer from the surface of the developing roller 6. As a result, too much of the toner is supplied between the developing roller 6 and the blade 7 and degrades the quality of the image.

SUMMARY OF THE INVENTION

The present invention has been developed in order to solve the above drawbacks and other problems associated with the conventional arrangement. An aspect of the present invention is to provide a toner layer regulating device and method for an image forming apparatus for uniformly maintaining a thickness of the toner supplied to a surface of a developing roller.

The foregoing and other aspects and advantages are substantially realized by providing a toner layer regulating device and method for an image forming apparatus. The apparatus and method comprise a blade body for elastically contacting a developing roller supplying toner to a photosensitive medium, and a bending portion bent at a predetermined angle from the contacting portion of the blade body and the developing roller to regulate a thickness of the toner that is transferred to the developing roller, wherein the blade body is formed such that its height is gradually reduced toward both ends of the blade body so that the toner supplied to the developing roller goes over the ends of the bending portion.

The respective ends of the bending portion are provided with a slant section, the slant section being formed such that the height from the contacting portion between the respective ends of the bending portion and the developing roller to the free ends of the blade is gradually reduced toward the ends of the bending portion with respect to the longitudinal direction of the developing roller.

The slant section includes a slant section having a predetermined slope.

The slant section includes a rounded slant section having a predetermined curvature.

The bending portion is bent at an angle substantially between 10 and 170 degrees.

On the other hand, in order to achieve the above aspect of the present invention, a developing unit of an image forming apparatus and method according to an embodiment of the present invention comprise a photosensitive medium, a developing roller for developing toner on the surface of the photosensitive medium, a toner supply roller for supplying the toner to the developing roller, a toner layer regulating blade for regulating a thickness of the toner that is elastically in contact with the developing roller and adheres to the surface of the developing roller, and sealing members that are respectively disposed on both ends of the toner supply roller in order to come into contact with both ends of the blade, wherein the blade is bent at a predetermined angle from the contacting portion that is in contact with the developing roller, and its height from the contacting portion to the free ends of the blade thereof is reduced towards both ends of the roller thereof.

The respective ends of the bending portion are provided with a slant section, the slant section being formed such that the height from the contacting portion between the respective ends of the bending portion and the developing roller to the free ends of the blade thereof is gradually reduced toward the ends of the bending portion with respect to the longitudinal direction of the developing roller.

The slant section includes a slant section having a certain slope.

The slant section includes a rounded slant section having a certain curvature.

The bending portion is bent at an angle substantially between 10 and 170 degrees.

On the other hand, in order to achieve the above aspect of the present invention, a developing unit of an image forming apparatus and method according to another embodiment of the present invention comprises a photosensitive medium, a developing roller for developing toner on the surface of the photosensitive medium, a toner supplying roller for supply the toner to the developing roller, a toner layer regulating blade for elastically contacting the developing roller to regulate a thickness of the toner adhering to the surface of the developing roller, and sealing members that are respectively disposed on both ends of the toner supply roller in order to come into contact with the both ends of the blade, wherein the blade is bent at a predetermined angle from the contacting portion that is in contact with the developing roller, and its height from the contacting portion to the free ends thereof is reduced towards the both ends thereof.

The blade comprises a blade body that is elastically in contact with a developing roller, and a bending portion for being bent from the contacting portion of the blade body and the developing roller to regulate the thickness of the toner that is transferred to the developing roller, wherein the bending portion is formed such that its height is gradually reduced toward the both ends thereof.

Also, the respective ends of the bending portion are provided with a slant section, the slant section being formed such that the height from the contacting portion of the respective ends and the developing roller to the free ends is gradually reduced toward the ends with respect to the longitudinal direction of the developing roller.

BRIEF DESCRIPTION OF THE DRAWINGS

The above aspects and features of the present invention will be more apparent by describing certain embodiments of the present invention with reference to the accompanying drawings, in which.

Throughout the drawings, it should be noted that the same or similar elements are denoted by like reference numerals.

DETAILED DESCRIPTION OF THE PREFERRED EMBODIMENTS

Embodiments of the present invention will now be described in greater detail with reference to the accompanying drawings.

Figure 1:
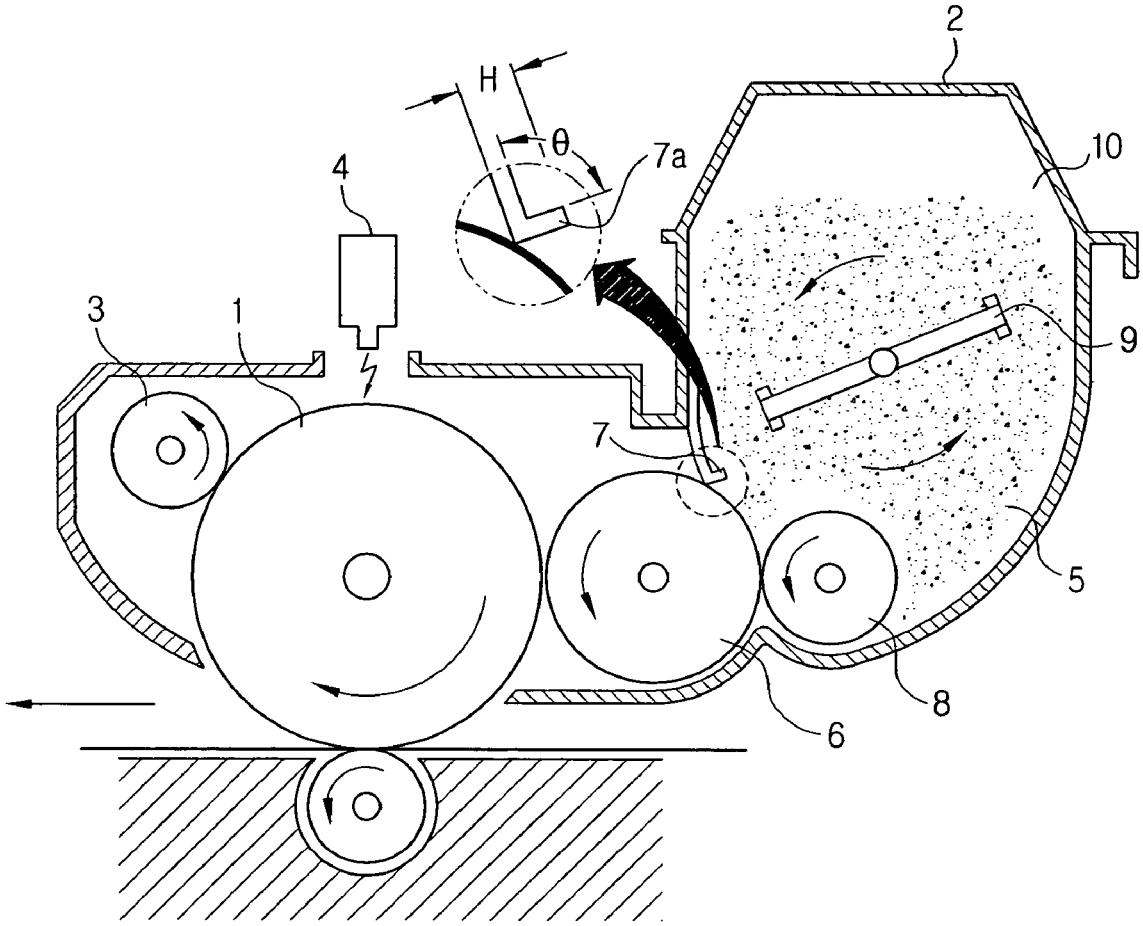
FIG. 1 (PRIOR ART)
FIG. 1 is a sectional view illustrating a developing unit of a conventional image forming apparatus.
Figure 2:
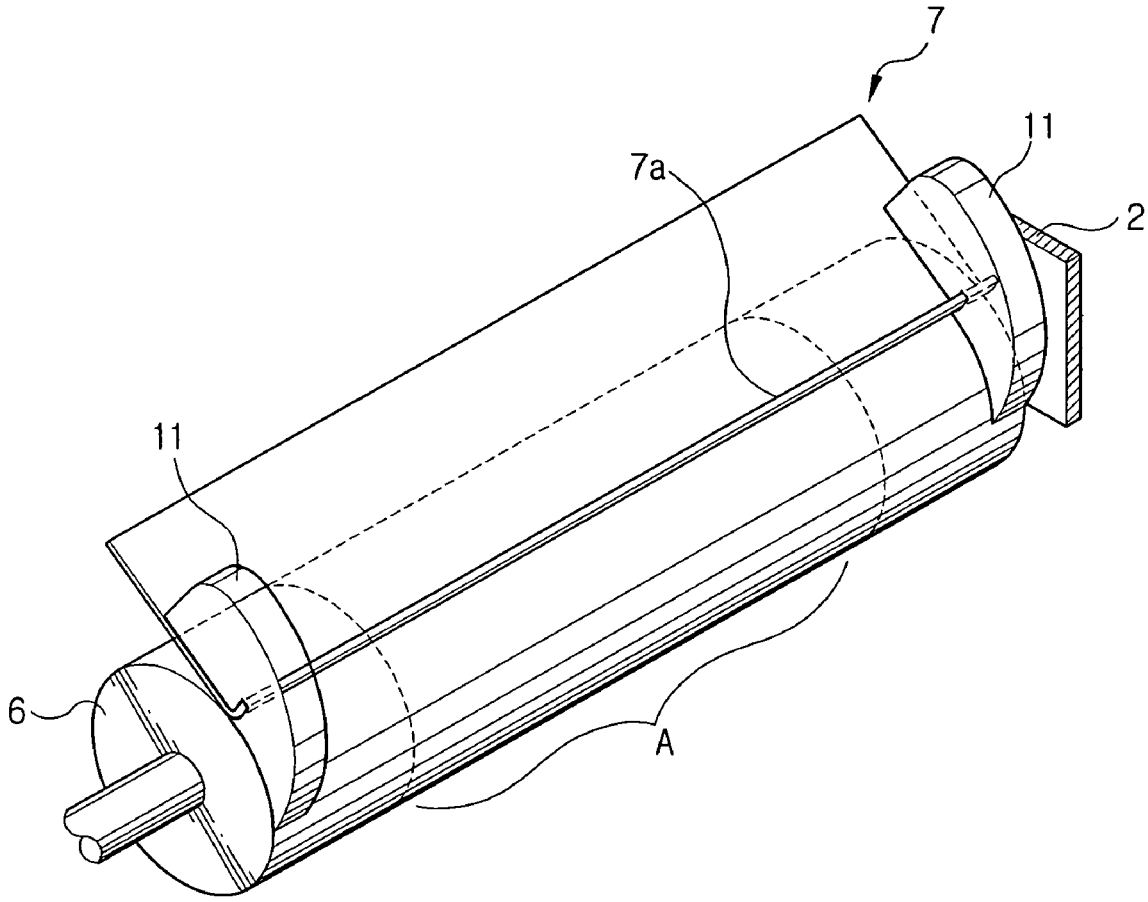
FIG. 2 (PRIOR ART)
FIG. 2 is a perspective view illustrating the main parts of FIG. 1.
Figure 3:
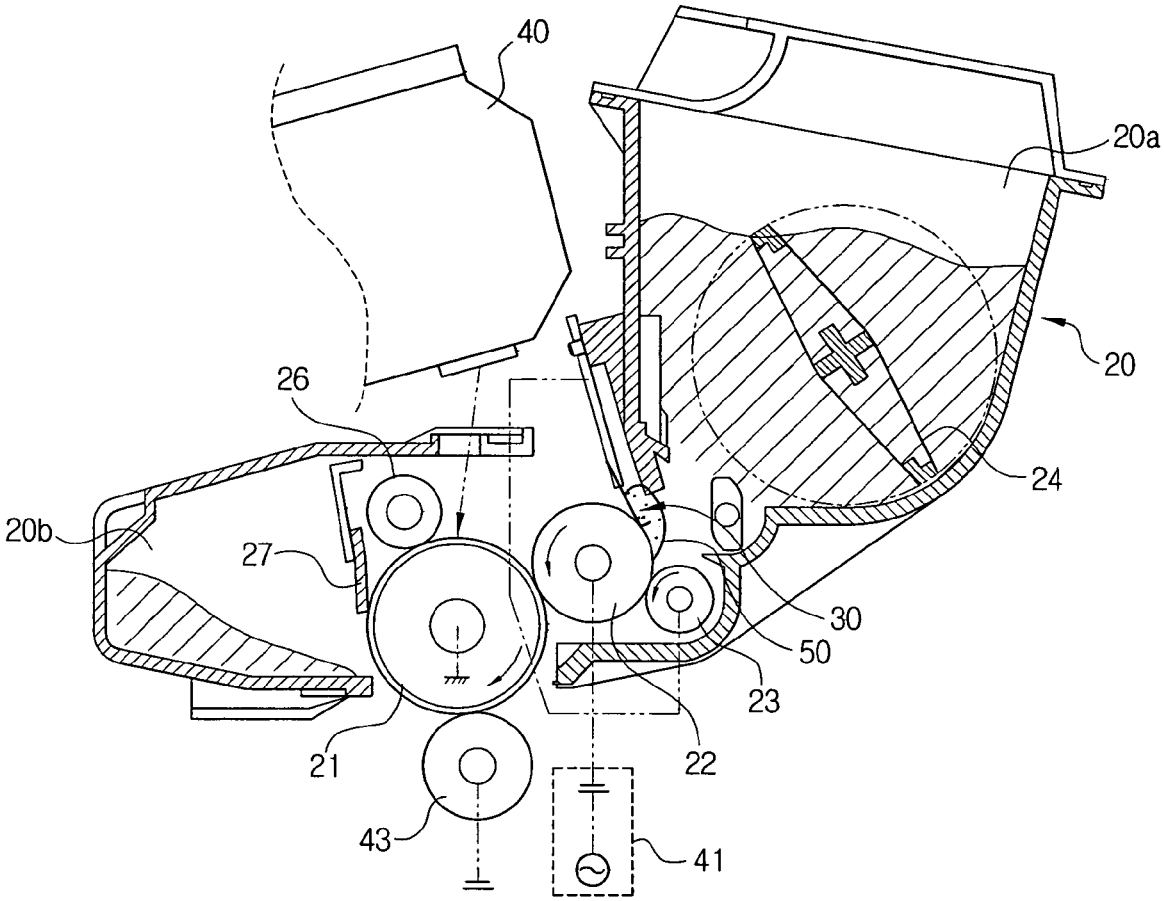
FIG. 3 is a sectional view illustrating a developing unit of the image forming apparatus according to an embodiment of the present invention.

With reference to FIG. 3, a developing unit of the image forming apparatus according to an embodiment of the present invention comprises a photosensitive drum 21 installed in a housing 20, a developing roller 22 for supplying a toner to the photosensitive drum 21, a toner supply roller 23 for supplying the toner to the developing roller 22, and a toner layer regulating device 30 for regulating the thickness of the toner supplied to the developing roller 22.

The housing 20 is divided into a toner receptacle 20*a* that accommodates the toner to be used for the development and an exhausted-toner receptacle 20*b* that accommodates the used toner. In the toner receptacle 20*a*, a toner agitator 24 is rotatably installed. The toner is a one-component non-magnetic developing agent, and comprises, for example, a resin material and an additive added to the surface of the resin material, or the like. The description of such a toner will be omitted since the make up of the toner is well known.

Also, the photosensitive drum 21 is rotatably mounted in contact with a charging roller 26. The charging roller 26 charges the surface of the photosensitive drum 21 at a predetermined potential. The charged surface is exposed by light scanned from an exposure unit 40, thereby forming an electrostatic latent image. Also, a cleaning blade 27 is installed in contact with the photosensitive drum 21 for removing the used toner on the photosensitive drum 21.

The developing roller 22 is rotatably provided while maintaining a predetermined developing gap with the photosensitive drum 21. The developing roller 22 is applied with an overlapping AC voltage and DC voltage from a power supply 41. Therefore, the toner on the surface of the developing roller 22 passes through the developing gap and moves to the electrostatic latent image area of the photosensitive drum 21 via a potential difference. It is preferable that the developing roller 22 comprises non-magnetic conductive rubber roller (e.g., rubber solidity having 50°–80°: Japanese Industrial Standards A Scale).

The toner supply roller 23 supplies the toner in the toner receptacle 20*a* to the developing roller 22 while being rotated in the same direction as the developing roller 22.

The toner layer regulating device 30 includes a regulating blade 31 (see FIG. 4) that is elastically installed in contact with the developing roller 22.

Figure 4:
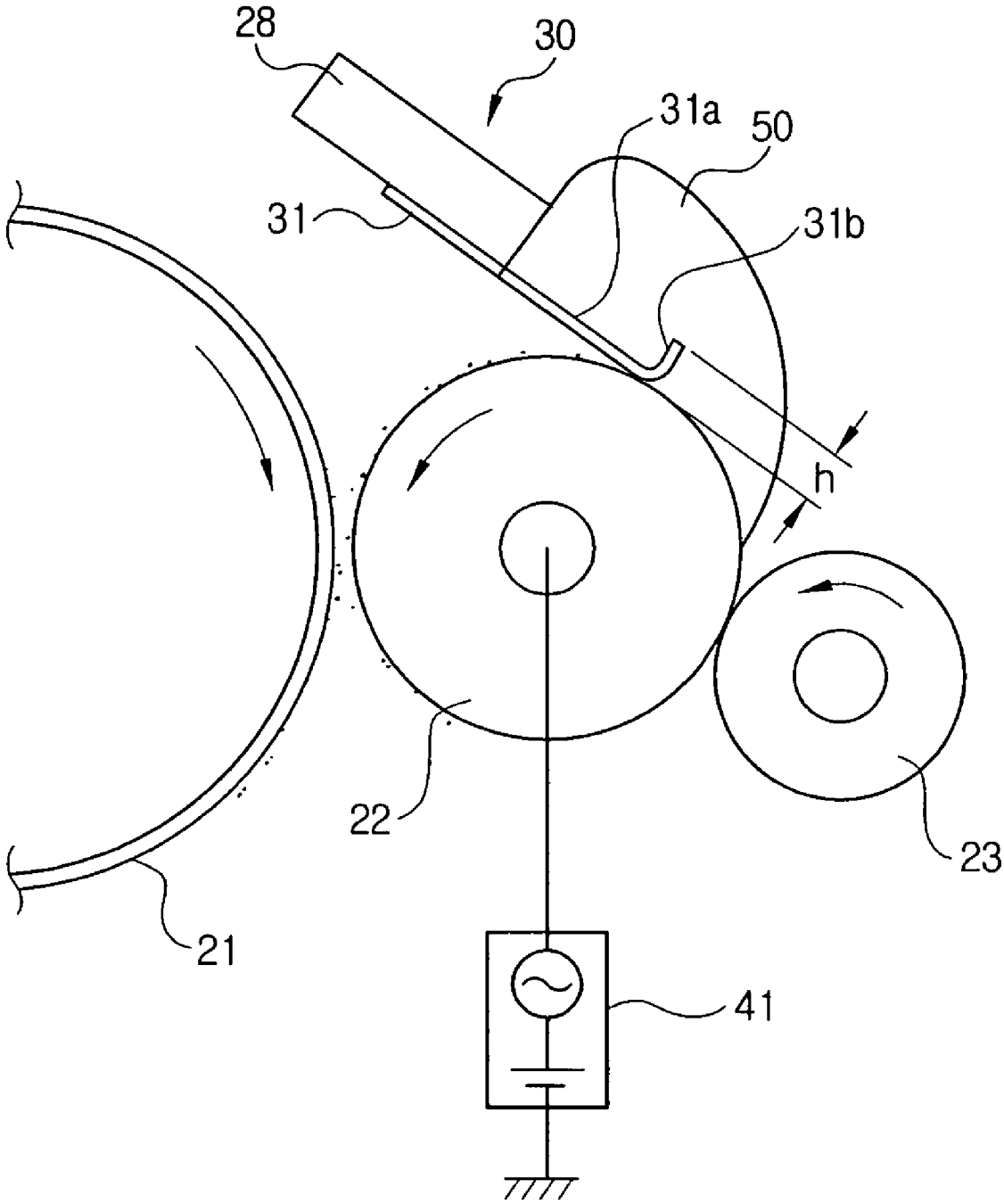
FIG. 4 is a sectional view illustrating the main portions of FIG. 3.

As shown in FIG. 4, the regulating blade 31 is supported by a supporting member 28 that is installed in the housing 20. The blade 31 may alternately be directly connected to the housing 20. The blade 31 uses any one of a stainless plate, a phosphor bronze plate, and a beryllium plate having thickness of about 0.05 mm–0.4 mm and elasticity. The blade 31 has a length corresponding to that of the developing roller 22.

The blade 31 includes a blade body 31*a* that is elastically in contact with the developing roller 22, and a bending portion 31*b* that is bent at a predetermined angle from the body 31*a*. The body 31*a* is in contact with the developing roller 22 at the contact pressure of about 25–50(gf/cm) by the elastic force. The bending portion 31*b* is bent within the angle range of substantially 10°–170° from the body 31*a*. Preferably, the angle is 90°. At this time, depending on the bent height h and the bending angle of the bending portion 31*a*, the thickness of the toner layer formed on the developing roller 22 is determined.

The toner is continuously supplied to the blade 31 by the toner supply roller 23. As a result, a part of the toner that is moved does not pass over the bending portion 31*b* and is subjected to pressure. With the pressure, the blade 31 is raised, and the toner passes through between the developing roller 22 and the blade 31 based on the raised height, resulting in the toner layer having a certain thickness being formed on the developing roller 22. Accordingly, as the height of the bending portion 31*b* increases, the pressure applied to the blade 31 is accordingly increased. If the blade 31 is raised greatly, a large amount of toner is supplied.

A sealing member 50 is installed corresponding to both ends of the developing roller 22. The sealing member 50 is provided to prevent the toner from moving toward the inner wall of the housing 20 through the developing roller 22 and both ends of the blade 31. The sealing member 50 can comprise sponge material.

A transfer roller 43 in FIG. 3 allows sheets to be passed between the transfer roller 43 and the photosensitive drum 21 while rotating in contact with the photosensitive drum 21.

Figure 5:
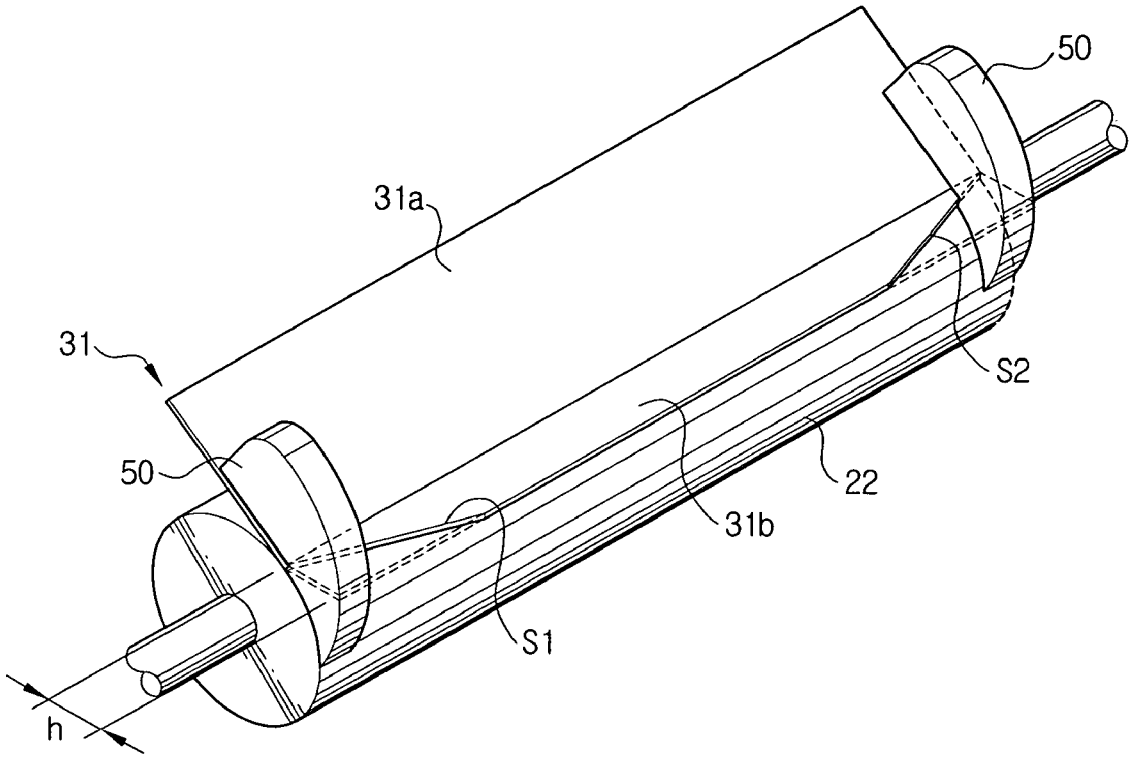
FIG. 5 is a perspective view illustrating the main portions of FIG. 3.

As shown in FIG. 5, the blade 31 is formed such that the height from a central portion of the blade 31 to both ends of the blade 31 thereof is gradually reduced. Each of the ends of the bending portion 31*b* is formed with slant sections S1 and S2 which are formed to gradually decrease in height. Also, each of the slant sections S1 and S2 is preferably formed with a linear slope. The slant sections S1 and S2, as shown in FIG. 5, may be simply formed by cut-processing the hiding-line portion of the bending portion 31. By forming the respective ends of the bending portion 31 with the slant sections S1 and S2 that are gradually decreased in height, and the toner does not linger at both ends of the bending portion 31*b*.

Figure 6:
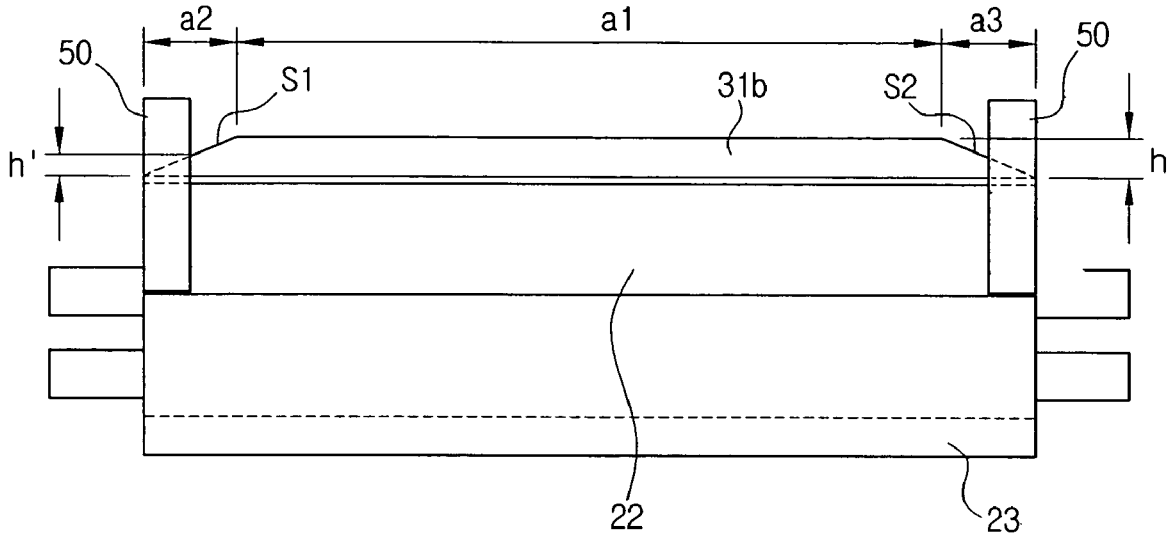
FIG. 6 is an elevation view of FIG. 5.

As shown in FIG. 6, in the section (a1) the height h of the bending portion 31*b* is uniform, the toner supplied to the developing roller 22 is subjected to the pressure while remaining based only on the height h of the bending portion 31*b*. On the other hand, in sections (a2) and (a3) the height h of the bending portion 31*b* is gradually reduced toward both ends thereof, the toner remains based only on the height h' of the bending portion 31*b*. Consequently, in both ends of the developing roller 22, there is relatively less toner at the ends than at the center. Thus, it is possible to prevent the toner from lingering and being subjected to physical stress, as in the conventional art. It is also possible to prevent the toner from being melted, adhering to the developing roller 22, and being fixed at a certain thickness by the frictional force.

In addition, since the height h' of both ends of the bending portion 31*b* is lower than the central portion thereof, both ends of the developing roller 22 are supplied with less toner. Accordingly, the toner is not excessively supplied to the ends of the developing roller 22 that do not substantially use the toner. Therefore, the influence on thickness of the toner layer used for the printing is minimized.

Figure 7A:
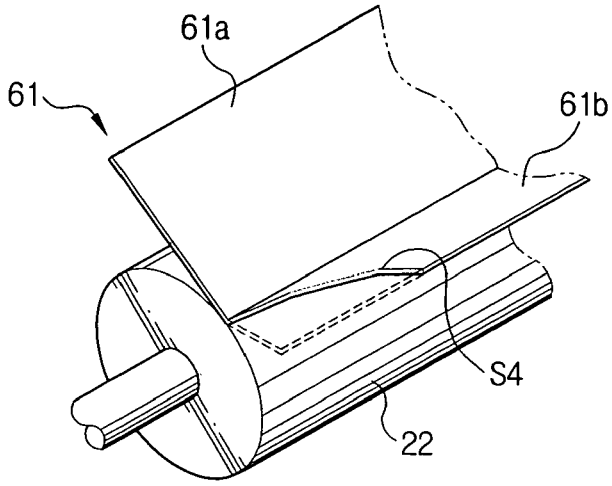
FIG. 7A and FIG. 7B are partly-cutout perspective views respectively showing the regulating blade according to another embodiment of the present invention.
Figure 7B:
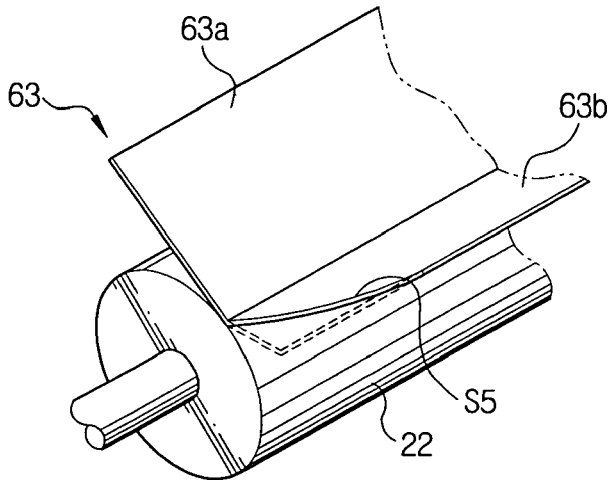

Also, as shown in FIG. 7A and FIG. 7B, the regulating blades 61 and 63 according to other embodiments of the present invention can be used. In FIG. 7A, a slant section S4 provided in the both ends of the bending portion 61*b* is formed having an inward rounded curve.

Also, in the case of FIG. 7B, the bending portion 63*b* of the regulating blade 63 has a slant section S5 that is formed having an outward rounded curve at each of the both ends thereof.

As described the above, in accordance with the regulating device and the developing unit of the image forming apparatus of the present invention, the toner can pass over the bending portion without lingering at both ends of the regulating blade. Accordingly, physical stress on the toner at both ends of the blade is minimized. As a result, the toner is prevented from adhering to the contacting portion of the developing roller and the blade due to the toner melting. Also, the toner is not supplied without being requested by a user because of the raised blade.

Thus, a high quality image can be developed by preventing the contamination of the image due to the over-leakage of the toner, especially in environments of low temperature with low moisture, and high temperature with high moisture, both ends of the image sheet are prevented from being contaminated due to the toner.

While the invention has been shown and described with reference to certain embodiments thereof, it should be understood by those skilled in the art that various changes in form and details may be made therein without departing from the spirit and scope of the invention as defined by the appended claims.

What is claimed is:

1. A toner layer regulating device of an image forming apparatus, comprising:

a blade body for elastically contacting a developing roller for supplying a toner to a photosensitive medium; and a bending portion bent at a predetermined angle from a contacting portion between the blade body and the developing roller for regulating a thickness of the toner that is transferred to the developing roller, wherein the bending portion is formed such that its height is gradually reduced toward both ends of the bending portion thereof.

2. The device as claimed in claim 1, wherein the respective ends of the bending portion are each provided with a slant section, the slant section being formed such that the height of the bending portion is gradually reduced from a center portion of the bending portion toward the ends of the bending portion with respect to the longitudinal direction of the developing roller.

3. The device as claimed in claim 2, wherein the slant section includes a slant portion having a certain slope.

4. The device as claimed in claim 2, wherein the slant section includes a rounded slant portion having a certain curvature.

5. The device as claimed in claim 1, wherein the bending portion is bent at an angle substantially between 10 and 170 degrees.

6. A developing unit of an image forming apparatus, comprising:

a photosensitive medium;

a developing roller for developing toner on the surface of the photosensitive medium;

a toner supply roller for supplying the toner to the developing roller;

a toner layer regulating blade for elastically contacting the developing roller for regulating the thickness of the toner adhering to the surface of the developing roller; and sealing members that are respectively disposed on both ends of the toner supply roller in order to come into contact with both ends of the blade, wherein the blade is bent at a predetermined angle from the contacting portion in contact with the developing roller, and its height from the contacting portion to free ends of the blade thereof is reduced towards both ends of the roller.

7. The developing unit as claimed in claim 6, wherein the blade comprises a blade body for elastically contacting a developing roller; and a bending portion bent at a predetermined angle from the contacting portion of the blade body and the developing roller for regulating the thickness of the toner that is transferred to the developing roller, wherein the bending portion is formed such that its height is gradually reduced toward both ends thereof of the bending portion.

8. The developing unit as claimed in claim 7, wherein the respective ends of the bending portion are each provided with a slant section, the slant section being formed such that the height of the bending portion is gradually reduced from a center portion of the bending portion toward the ends of the blade with respect to the longitudinal direction of the developing roller.

9. A method for regulating toner thickness for an image forming apparatus, comprising:

elastically contacting a developing roller for supplying a toner to a photosensitive medium via a blade body; and bending a bending portion at a predetermined angle from a contacting portion between the blade body and the developing roller for regulating a thickness of the toner that is transferred to the developing roller, wherein the bending portion is formed such that its height is gradually reduced toward both ends of the bending portion thereof.

10. The method as claimed in claim 9, wherein the respective ends of the bending portion are each provided with a slant section, the slant section being formed such that the height of the bending portion is gradually reduced from a center portion of the bending portion toward the ends of the bending portion with respect to the longitudinal direction of the developing roller.

11. The device as claimed in claim 10, wherein the slant section includes a slant portion having a certain slope.

12. The device as claimed in claim 10, wherein the slant section includes a rounded slant portion having a certain curvature.

13. The device as claimed in claim 9, wherein the bending portion is bent at an angle substantially between 10 and 170 degrees.

* * * * *